US011348721B2

(12) United States Patent
Sasaki et al.

(10) Patent No.: US 11,348,721 B2
(45) Date of Patent: May 31, 2022

(54) COIL COMPONENT AND METHOD OF MANUFACTURING COIL COMPONENT

(71) Applicant: MURATA MANUFACTURING CO., LTD., Kyoto-fu (JP)

(72) Inventors: Tatsuya Sasaki, Nagaokakyo (JP); Shinya Hirai, Nagaokakyo (JP); Shin Hasegawa, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 1248 days.

(21) Appl. No.: 15/720,416

(22) Filed: Sep. 29, 2017

(65) Prior Publication Data

US 2018/0025831 A1 Jan. 25, 2018

Related U.S. Application Data

(63) Continuation of application No. PCT/JP2017/010171, filed on Mar. 14, 2017.

(30) Foreign Application Priority Data

Apr. 1, 2016 (JP) ..... JP2016-074225

(51) Int. Cl.
*H01F 27/28* (2006.01)
*H01F 27/29* (2006.01)
(Continued)

(52) U.S. Cl.
CPC ..... *H01F 27/29* (2013.01); *H01F 17/062* (2013.01); *H01F 27/2828* (2013.01);
(Continued)

(58) Field of Classification Search
USPC ..... 336/221, 192, 198, 233, 90
See application file for complete search history.

(56) References Cited

U.S. PATENT DOCUMENTS 5,719,547 A * 2/1998 Kaneko ..... H01F 27/29 336/180
2002/0080001 A1* 6/2002 Kobayashi ..... H03H 7/427 336/229

(Continued)

FOREIGN PATENT DOCUMENTS

CN 1499914 A 5/2004
CN 104465034 A 3/2015

(Continued)

OTHER PUBLICATIONS

An Office Action mailed by the Chinese Patent Office dated Sep. 27, 2018, which corresponds to Chinese Patent Application No. 201780001421.8 and is related to U.S. Appl. No. 15/720,416 with English language translation.

(Continued)

*Primary Examiner* — Shawki S Ismail
*Assistant Examiner* — Kazi S Hossain
(74) *Attorney, Agent, or Firm* — Studebaker & Brackett PC

(57) ABSTRACT

A coil component includes: a core having an annular shape; a coil wound around the core; and an electrode terminal for mounting the coil component. The electrode terminal is connected to the coil and has a mounting surface. The coil is formed by connecting a plurality of wire members. The electrode terminal has a recessed portion indented toward a back surface on a side opposite to the mounting surface. The wire member of the coil is connected to a back surface of a bottom portion of the recessed portion.

8 Claims, 8 Drawing Sheets

(51) Int. Cl.

| | |
|---|---|
| ***H01F 17/06*** | (2006.01) |
| ***H01F 41/10*** | (2006.01) |
| ***H01F 41/02*** | (2006.01) |
| *H01F 17/00* | (2006.01) |

(52) U.S. Cl.
CPC ..... *H01F 27/292* (2013.01); *H01F 41/02* (2013.01); *H01F 41/10* (2013.01); *H01F 2017/0093* (2013.01)

(56) References Cited

U.S. PATENT DOCUMENTS

| | | | | |
|---|---|---|---|---|
| 2010/0007451 | A1* | 1/2010 | Yan | H01F 17/043 336/90 |
| 2010/0277267 | A1 | 11/2010 | Bogert et al. | |
| 2012/0119864 | A1* | 5/2012 | Lint | H01F 27/02 336/192 |
| 2015/0097648 | A1* | 4/2015 | Kido | H01F 41/046 336/200 |

FOREIGN PATENT DOCUMENTS

| | | | |
|---|---|---|---|
| JP | S50-20152 | U | 3/1975 |
| JP | 3007983 | U | 2/1995 |
| JP | 2006-165212 | A | 6/2006 |
| JP | 2007-208122 | A | 8/2007 |
| JP | 2012-028684 | A | 2/2012 |
| JP | 2012-164833 | A | 8/2012 |
| WO | 2010/129256 | A1 | 11/2010 |

OTHER PUBLICATIONS

International Search Report issued in PCT/JP2017/010171; dated May 30, 2017.
Written Opinion issued in PCT/JP2017/010171; dated May 30, 2017.
An Office Action issued by the German Patent Office dated Oct. 16, 2020, which corresponds to German Patent Application No. 11 2017 000 026.2 and is related to U.S. Appl. No. 15/720,416 with English language translation.

* cited by examiner

COIL COMPONENT AND METHOD OF MANUFACTURING COIL COMPONENT

CROSS REFERENCE TO RELATED APPLICATIONS

This application claims benefit of priority to Japanese Patent Application 2016-074225 filed Apr. 1, 2016, and to International Patent Application No. PCT/JP2017/010171 filed Mar. 14, 2017, the entire content of which is incorporated herein by reference.

TECHNICAL FIELD

The present disclosure relates to a coil component and a method of manufacturing the coil component.

BACKGROUND

Conventionally, as a coil component, there has been known a coil component described in Japanese Patent Application Laid-Open No. 2006-165212. The coil component includes an insulating substrate, a core embedded in the insulating substrate, a coil wound around the core and an electrode part connected to the coil through a routing wire.

SUMMARY

Technical Problem

In mounting the above-mentioned conventional coil component on a mounting board, inventors of the present disclosure have found the following drawback. That is, in mounting the coil component on the mounting board in such a manner that an electrode terminal is connected to the electrode part of the coil component and the electrode terminal is mounted on the mounting board through a solder, when the solder expands or contracts due to a thermal shock, the electrode terminal receives a stress of the solder. As a result, there is a possibility that damage occurs at a connecting portion between the electrode terminal and the electrode part. That is, the conduction between the electrode terminal and the coil is interrupted.

The present disclosure has been made in view of such drawbacks, and it is an object of the present disclosure to provide a coil component which can maintain favorable conduction between a coil and an electrode terminal, and a method of manufacturing the coil component.

Solutions to Problem

To overcome the above-mentioned drawbacks, the present disclosure provides a coil component which includes:

a core having an annular shape;

a coil wound around the core; and an electrode terminal for mounting the coil component, the electrode terminal connected to the coil and having a mounting surface, wherein the coil is formed by connecting a plurality of wire members, the electrode terminal has a recessed portion indented toward a back surface on a side opposite to the mounting surface, and the wire member of the coil is connected to a back surface of a bottom portion of the recessed portion.

In this specification, "wire member" does not mean a printed wire but means a rod-shaped member.

According to the coil component of the present disclosure, the electrode terminal has the recessed portion indented toward the back surface thereof, and the wire member of the coil is connected to the back surface of the bottom portion of the recessed portion. With such a configuration, in mounting a mounting surface of the electrode terminal on a mounting board through the solder, the bottom portion of the recessed portion can be disposed away from the solder. That is, the connecting portion between the bottom portion of the recessed portion and the wire member can be disposed away from the solder. With such a configuration, even when the solder expands or contracts due to a thermal shock, a stress of the solder can be absorbed by a portion between the mounting surface and the bottom portion of the recessed portion. As a result, peeling-off between the recessed portion and the wire member which are connected to each other can be suppressed. Accordingly, the favorable conduction between the coil and the electrode terminal can be maintained.

In one embodiment of the coil component, the wire member is connected to the recessed portion by welding.

According to this embodiment, the wire member is connected by welding and hence, electric resistance can be reduced compared to solder bonding.

In one embodiment of the coil component, the electrode terminal includes a copper plate and a plating film which covers the copper plate, and the copper plate is exposed from the plating film on a mounting surface side of the bottom portion of the recessed portion.

According to this embodiment, the copper plate is exposed from the plating film on the mounting surface side of the bottom portion of the recessed portion and hence, the copper plate is oxidized so that it is possible to prevent the solder from wetting on the bottom portion of the recessed portion. Accordingly, it is possible to make the bottom portion of the recessed portion disposed away from the solder with more certainty and hence, it is possible to prevent a stress of the solder from being applied to the connecting portion between the bottom portion of the recessed portion and the wire member with more certainty.

In one embodiment of the coil component, the electrode terminal includes a connecting portion which is connected to the mounting board on a peripheral edge of the recessed portion on an opening side of the recessed portion.

According to this embodiment, the electrode terminal includes the connecting portion which is connected to the mounting board on the peripheral edge of the recessed portion on the opening side. With such a configuration, when the connecting portion of the electrode terminal is mounted on the mounting board, an electric current radially flows along the periphery of the recessed portion between the wire member connected to the recessed portion and the mounting board. Accordingly, electric resistance can be reduced.

In one embodiment of the coil component, the coil component includes a case which accommodates the core and the coil, and on which the electrode terminal is mounted, and the case has a hole portion in which the recessed portion of the electrode terminal is fitted.

According to this embodiment, the case has the hole portion in which the recessed portion of the electrode terminal is fitted and hence, a mounting strength of the electrode terminal with respect to the case is increased.

In another embodiment of a coil component, the coil component includes:

a core having an annular shape;

a coil wound around the core;

an electrode terminal for mounting the coil component, the electrode terminal connected to the coil and having a mounting surface; and a case covering the core and the coil and having a hole portion on a bottom surface thereof, wherein the coil is formed by connecting a plurality of wire members, the electrode terminal has a recessed portion indented toward a back surface on a side opposite to the mounting surface, and the recessed portion of the electrode terminal is fitted and disposed in the hole portion of the case from a bottom surface side, and the wire member of the coil is connected to a back surface of a bottom portion of the recessed portion.

According to this embodiment, the electrode terminal has the recessed portion indented toward the back surface thereof, and the wire member of the coil is connected to the back surface of the bottom portion of the recessed portion. With such a configuration, in mounting a mounting surface of the electrode terminal on a mounting board through a solder, the bottom portion of the recessed portion can be disposed away from the solder. That is, a connecting portion between the bottom portion of the recessed portion and the wire member can be disposed away from the solder. With such a configuration, even when the solder expands or contracts due to a thermal shock, a stress of the solder can be absorbed by a portion between the mounting surface and the bottom portion of the recessed portion. As a result, peeling-off between the recessed portion and the wire member which are connected to each other can be suppressed. Accordingly, the favorable conduction between the coil and the electrode terminal can be maintained. Further, the case has the hole portion in which the recessed portion of the electrode terminal is fitted and hence, a mounting strength of the electrode terminal with respect to the case is increased.

In one embodiment of a method of manufacturing a coil component which includes: a core having an annular shape; a coil wound around the core and formed by connecting a plurality of wire members; and an electrode terminal for mounting the coil component, the electrode terminal connected to the coil and having a mounting surface, and having a recessed portion indented toward a back surface on a side opposite to the mounting surface, wherein the wire member of the coil is connected to a back surface of a bottom portion of the recessed portion by applying welding from a mounting surface side of the bottom portion of the recessed portion in a state where the wire member is brought into contact with the back surface of the bottom portion of the recessed portion.

According to this embodiment, the wire member of the coil is connected to the back surface of the bottom portion of the recessed portion by applying welding from the mounting surface side of the bottom portion of the recessed portion in a state where the wire member is brought into contact with the back surface of the bottom portion of the recessed portion and hence, welding can be performed easily.

Further, the electrode terminal has the recessed portion indented toward the back surface thereof, and the wire member of the coil is connected to the back surface of the bottom portion of the recessed portion. With such a configuration, in mounting a mounting surface of the electrode terminal on the mounting board through the solder, the bottom portion of the recessed portion can be disposed away from the solder. That is, the connecting portion between the bottom portion of the recessed portion and the wire member can be disposed away from the solder. With such a configuration, even when the solder expands or contracts due to a thermal shock, a stress of the solder can be absorbed by a portion of the recessed portion between the mounting surface and the bottom portion. As a result, peeling-off between the recessed portion and the wire member which are connected to each other can be suppressed. Accordingly, the favorable conduction between the coil and the electrode terminal can be maintained.

In one embodiment of the coil component, the wire member is connected to the back surface of the bottom portion of the recessed portion by applying laser welding from the mounting surface side of the bottom portion of the recessed portion.

According to this embodiment, the wire member is connected to the back surface of the bottom portion of the recessed portion by applying laser welding from the mounting surface side of the bottom portion of the recessed portion and hence, in the case where the electrode terminal includes a copper plate and a plating film which covers the copper plate, the copper plate is exposed from the plating film on the mounting surface side of the bottom portion of the recessed portion. Accordingly, the copper plate is oxidized so that it is possible to prevent the solder from wetting on the bottom portion of the recessed portion. As a result, it is possible to make the bottom portion of the recessed portion disposed away from the solder with more certainty and hence, it is possible to prevent a stress of the solder from being applied to the connecting portion between the bottom portion of the recessed portion and the wire member with more certainty.

Advantageous Effect of the Disclosure

According to the coil component of the present disclosure, the electrode terminal has the recessed portion indented toward the back surface thereof, and the wire member of the coil is connected to the back surface of the bottom portion of the recessed portion. Accordingly, in mounting the mounting surface of the electrode terminal on the mounting board through the solder, the bottom portion of the recessed portion can be disposed away from the solder and hence, the favorable conduction between the coil and the electrode terminal can be maintained.

DETAILED DESCRIPTION

Hereinafter, the present disclosure is described in detail with reference to an embodiment shown in drawings.

(Configuration of Coil Component)

Figure 1:
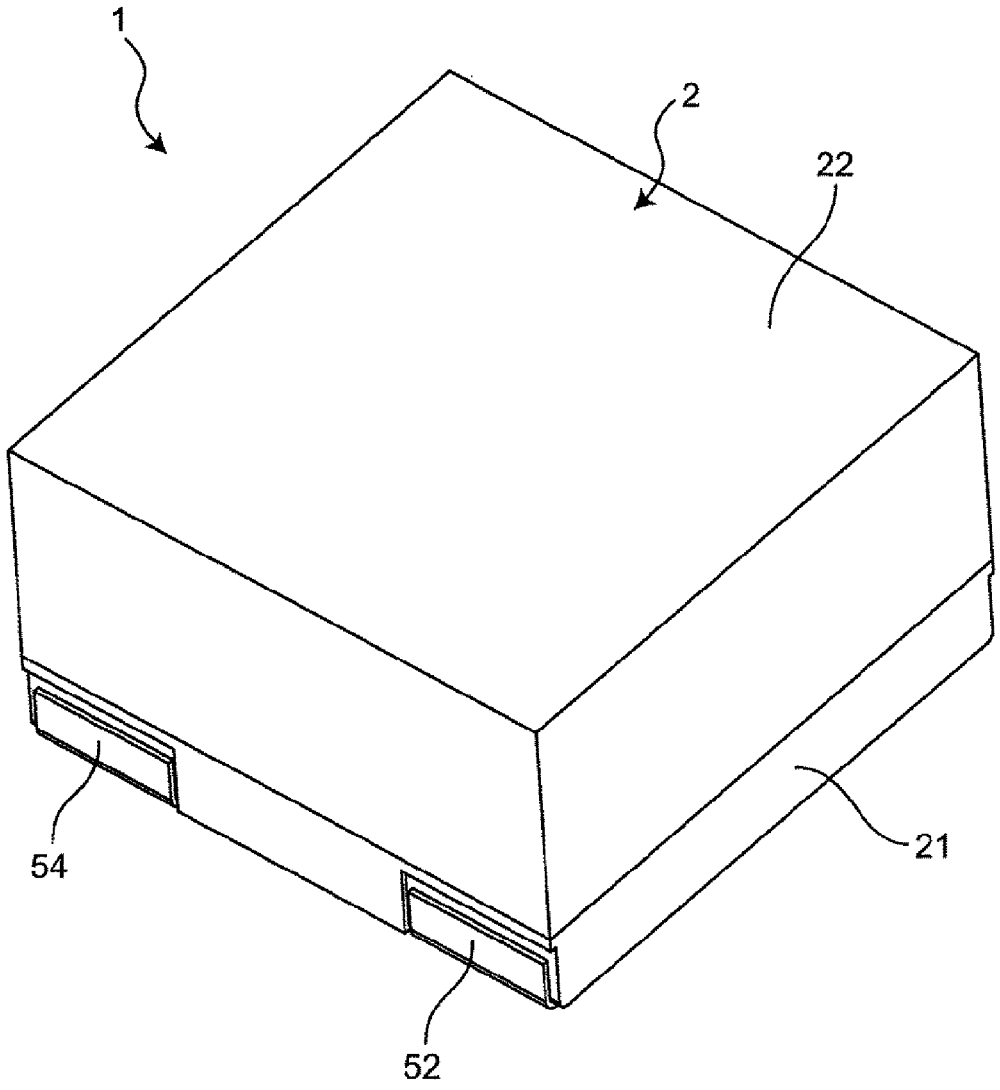
FIG. 1 is an upper perspective view showing a coil component according to one embodiment of the present disclosure.
Figure 2:
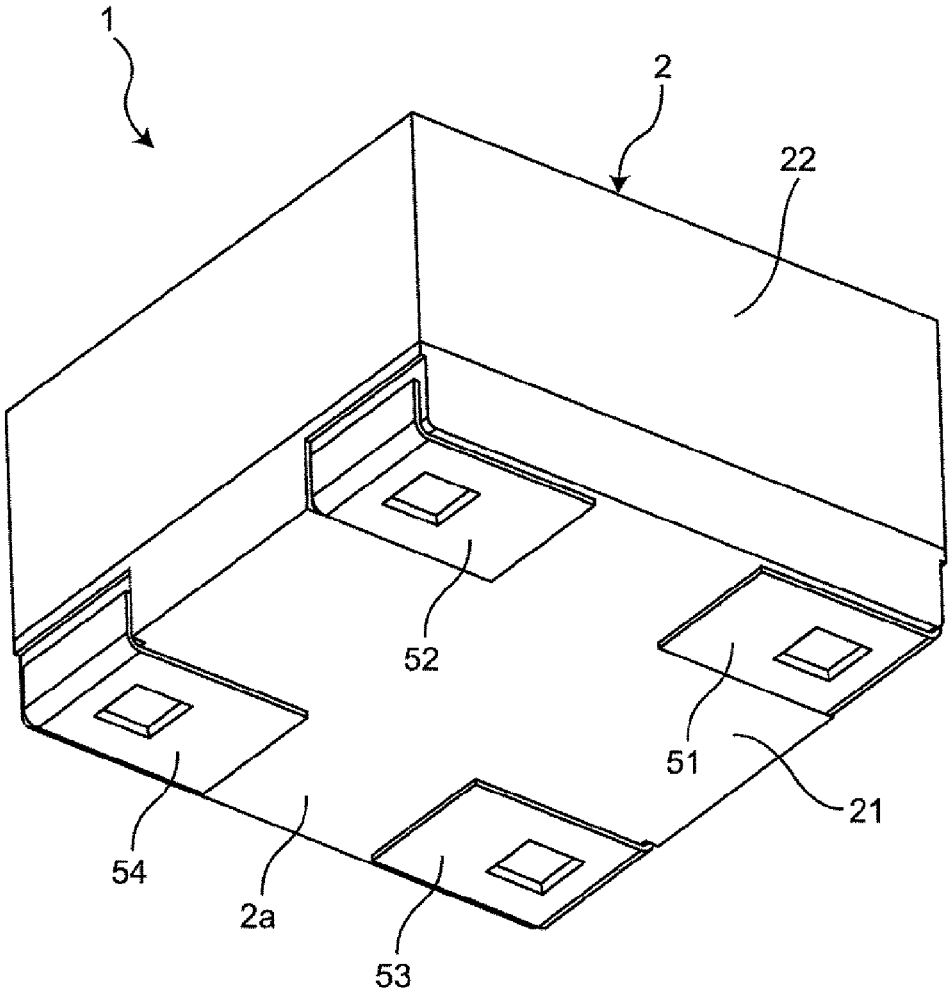
FIG. 2 is a lower perspective view of the coil component.
Figure 3:
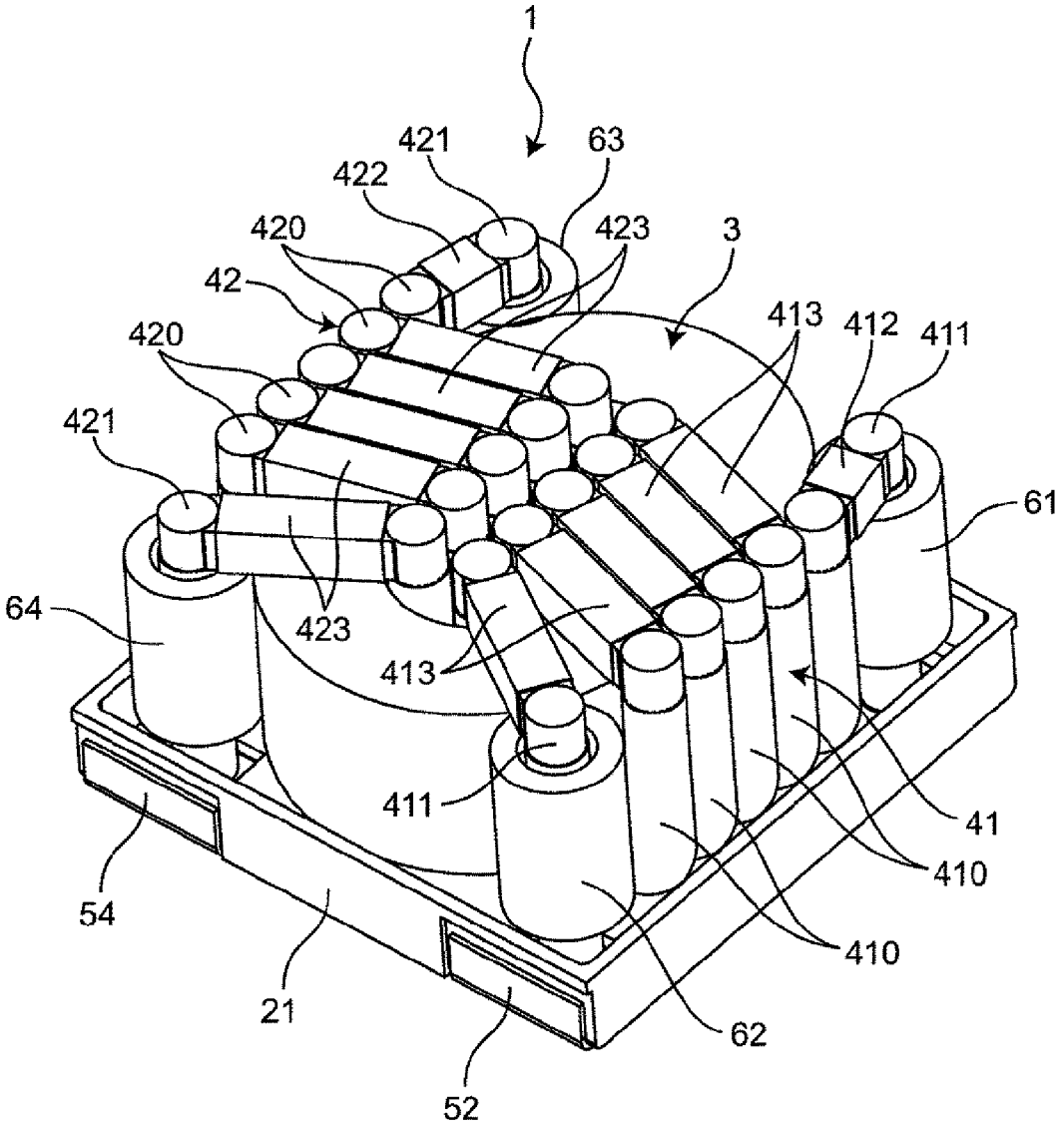
FIG. 3 is an upper perspective view showing the inside of the coil component.
Figure 4:
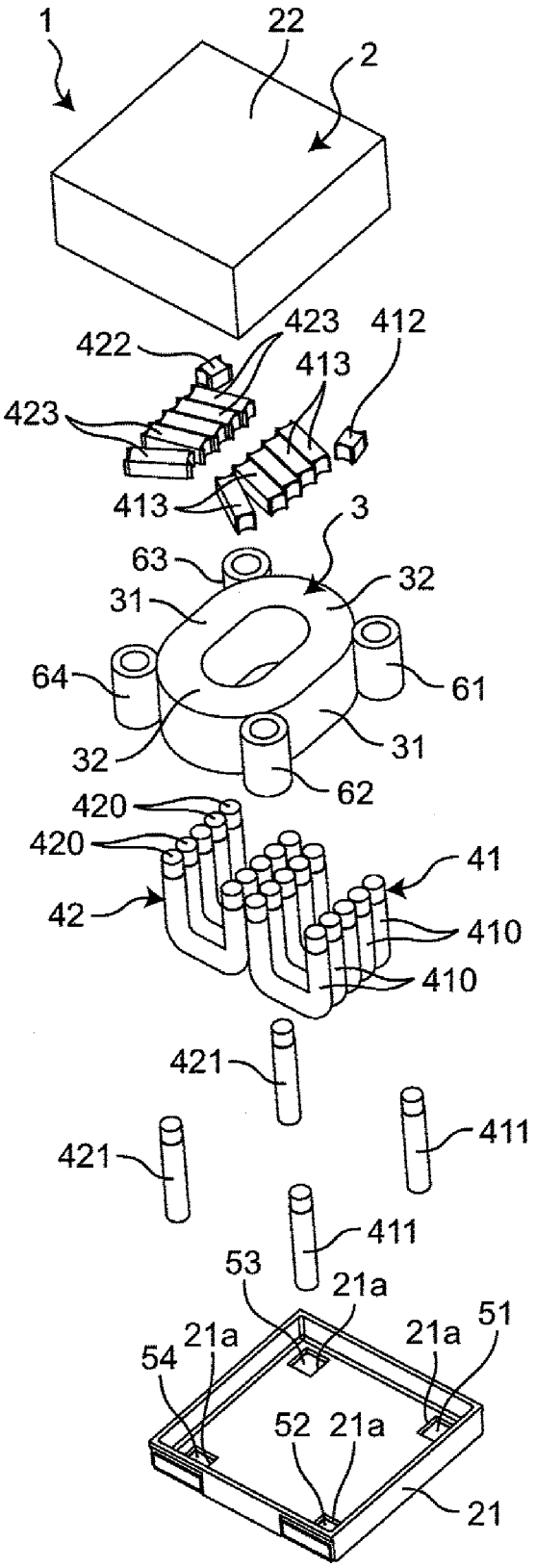
FIG. 4 is an exploded perspective view of the coil component.

FIG. 1 is an upper perspective view showing a coil component according to one embodiment of the present disclosure. FIG. 2 is a lower perspective view of the coil component. FIG. 3 is an upper perspective view showing the inside of the coil component. FIG. 4 is an exploded perspective view of the coil component.

As shown in FIG. 1 to FIG. 4, the coil component 1 includes: a case 2; a core 3 having an annular shape which is accommodated in the case 2; a first coil 41 and a second coil 42 wound around the core 3 such that the first coil 41 and the second coil 42 face each other; and first to fourth ferrite beads 61 to 64 mounted on the first coil 41 and the second coil 42. The coil component 1 is a common mode choke coil.

The case 2 includes a bottom plate portion 21 and a box-shaped lid portion 22 which covers the bottom plate portion 21. The case 2 is made of a resin such as polyphenylenesulfide or ceramic, for example. The core 3 is mounted on the bottom plate portion 21. The core 3 is mounted on the bottom plate portion 21 such that a center axis of the core 3 is orthogonal to the bottom plate portion 21. The center axis of the core 3 means a center axis of an inner-diameter hole portion of the core 3. A shape of the case 2 (the bottom plate portion 21 and the lid portion 22) is a quadrangular shape as viewed in the direction of the center axis of the core 3. In this embodiment, the shape of the case 2 is square. The shape of the case 2 may be rectangular.

Electrode terminals 51 to 54 for mounting the coil component 1 are mounted on the bottom plate portion 21. The first electrode terminal 51 and the second electrode terminal 52 are positioned at two corners of a quadrangular shape of the bottom plate portion 21 which face each other, and the third electrode terminal 53 and the fourth electrode terminal 54 are positioned at two corners of the quadrangular shape of the bottom plate portion 21 which face each other. The first electrode terminal 51 and the third electrode terminal 53 face each other, and the second electrode terminal 52 and the fourth electrode terminal 54 face each other.

The electrode terminals 51 to 54 are mounted on a bottom surface 2*a* of the bottom plate portion 21. Hole portions 21*a* are formed in the bottom plate portion 21, and the inside and the outside of the case 2 are made to communicate with each other through the hole portions 21*a*. The electrode terminals 51 to 54 are made to overlap with the hole portions 21*a* thus being exposed to the inside of the case 2 through the hole portions 21*a*. The electrode terminals 51 to 54 are fixed to the case 2 by adhesion.

A shape of the core 3 (that is, a shape of an inner peripheral surface and an outer peripheral surface of the core 3) is an oblong shape (track shape) as viewed in the direction of the center axis. As viewed in the direction of the center axis, the core 3 includes: long side portions 31 forming a pair which extend along a major axis of the core 3 and opposedly face each other; and short side portions 32 forming a pair which extend along a minor axis of the core 3 and opposedly face each other. The shape of the core 3 may be a circular shape, a rectangular shape, or an elliptical shape.

The core 3 is formed of a ceramic core such as a ferrite core, or of a metal-based core, for example. The core 3 includes two end surfaces which are disposed opposite to each other in the direction of the center axis. One end surface of the core 3 opposedly faces an inner surface of the bottom plate portion 21. The other end surface of the core 3 opposedly faces an inner surface of the lid portion 22. The core 3 is accommodated in the case 2 such that the direction of the major axis of the core 3 agrees with the direction of one side of the case 2 (bottom plate portion 21).

The first coil 41 is wound around the core 3 between the first electrode terminal 51 and the second electrode terminal 52. One end of the first coil 41 is connected to the first electrode terminal 51. The other end of the first coil 41 is connected to the second electrode terminal 52.

The second coil 42 is wound around the core 3 between the third electrode terminal 53 and the fourth electrode terminal 54. One end of the second coil 42 is connected to the third electrode terminal 53. The other end of the second coil 42 is connected to the fourth electrode terminal 54.

The first coil 41 and the second coil 42 are respectively wound around the core 3 along the direction of the major axis of the core 3 such that the first coil 41 and the second coil 42 face each other in the direction of the minor axis of the core 3. That is, the first coil 41 is wound around one long side portion 31 of the core 3, and the second coil 42 is wound around the other long side portion 31 of the core 3. The direction along which the first coil 41 is wound around the core and the direction along which the second coil 42 is wound around the core 3 are opposite to each other. The number of turns of the first coil 41 and the number of turns of the second coil 42 are equal.

The first to fourth ferrite beads 61 to 64 are made of a magnetic material such as a NiZn ferrite or a MnZn ferrite, for example. The ferrite beads 61 to 64 are respectively formed into a cylindrical shape, and are disposed at four corners of the case 2. An axis of each of the ferrite beads 61 to 64 is parallel to the center axis of the core 3. The ferrite beads 61 to 64 are positioned outside the core 3 in the radial direction of the core 3.

The first ferrite bead 61 is positioned on one end side (first electrode terminal 51 side) of the first coil 41. The second ferrite bead 62 is positioned on the other end side (second electrode terminal 52 side) of the first coil 41. The third ferrite bead 63 is positioned on one end side (third electrode terminal 53 side) of the second coil 42. The fourth ferrite bead 64 is positioned on the other end side (fourth electrode terminal 54 side) of the second coil 42.

The first coil 41 is formed by connecting a plurality of wire members by laser welding, spot welding, solder bonding or the like, for example. The plurality of wire members are not printed wires, but are rod-shaped members. The wire member may have rigidity, or may have flexibility. The plurality of wire members include: bent wire members 410 each of which is bent in an approximately U shape; and straight wire members 411, 412, 413 each of which extends approximately in a straight line shape. The first coil 41 includes, in order from one end to the other end: the first straight wire member 411; the second straight wire member 412; plural sets (five sets in this embodiment) each of which is formed of the bent wire member 410 and the third straight wire member 413; and the first straight wire member 411. The first, second and third straight wire members 411, 412, 413 have different lengths respectively.

The wire members 410 to 413 are polyamide-imide copper wires, for example, and each wire member includes a copper wire and an insulating film which covers the copper wire. A thickness of the insulating film is 0.02 mm to 0.04 mm, for example. The insulating film is covered by an insulating coating, and a material for forming the insulating coating is a polyamide-imide resin.

The bent wire members 410 and the third straight wire members 413 are connected with each other by laser welding, spot welding, solder bonding or the like, for example, such that the bent wire member 410 and the third straight wire member 413 are alternately connected with each other. One end of the third straight wire member 413 is connected to one end of the bent wire member 410, and the other end of the third straight wire member 413 is connected to one end of another bent wire member 410. By repeating such a connecting operation, the plurality of bent wire members 410 and the plurality of third straight wire members 413 are spirally wound around the core 3. That is, one set which is formed of the bent wire member 410 and the third straight wire member 413 forms a unit element for one turn. The first coil 41 is wound around the core 3 by five turns.

The first straight wire member 411 is inserted into the first and second ferrite beads 61, 62 respectively. The first straight wire member 411 inserted into the first ferrite bead 61 is connected to the first electrode terminal 51. The first straight wire member 411 inserted into the second ferrite bead 62 is connected to the second electrode terminal 52.

In the same manner as the first coil 41, the second coil 42 is formed of a plurality of wire members. That is, the second coil 42 includes, in order from one end to the other end: a first straight wire member 421; a second straight wire member 422; plural sets (five sets in this embodiment) each of which is formed of a bent wire member 420 and a third straight wire member 423; and the first straight wire member 421. The bent wire members 420 and the third straight wire members 423 are wound around the core 3 such that the bent wire member 420 and the third straight wire member 423 are alternately connected with each other. The second coil 42 is wound around the core 3 by five turns. The first straight wire member 421 is inserted into the third and fourth ferrite beads 63, 64 respectively.

Figure 5:
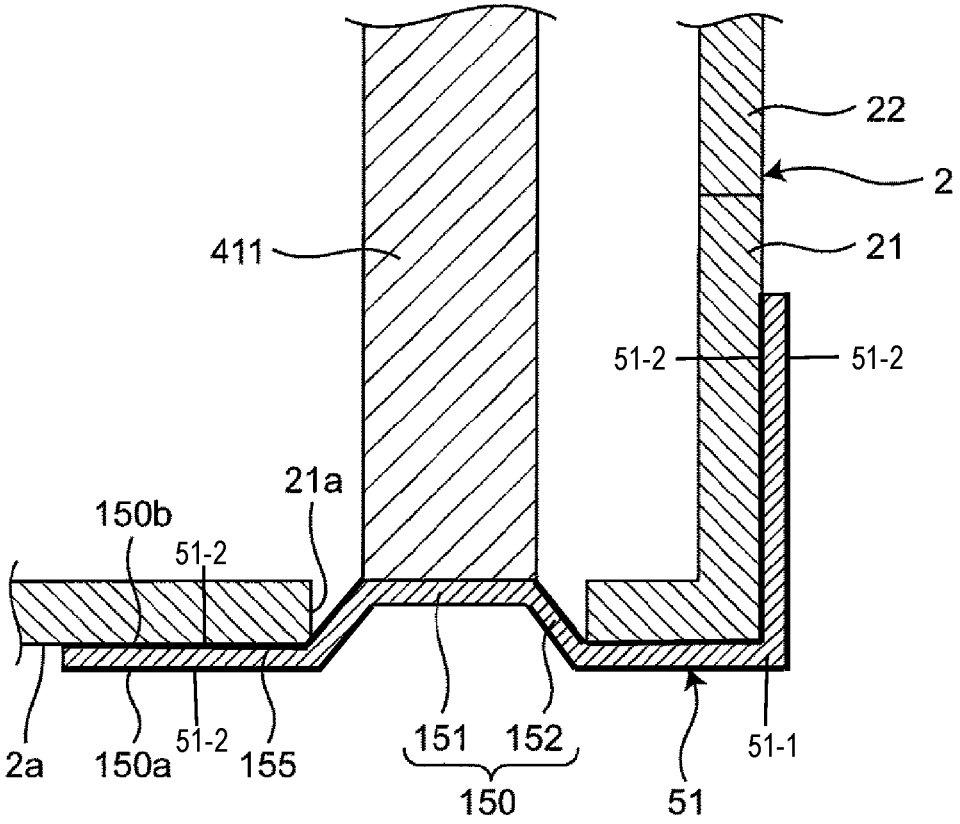
FIG. 5 is a cross-sectional view of the coil component on a first electrode terminal side.

FIG. 5 is a cross-sectional view of the coil component on the first electrode terminal 51 side. In FIG. 5, the description of the first ferrite bead 61 is omitted. Hereinafter, although the first electrode terminal 51 is described, the second to fourth electrode terminals 52 to 54 also have the same configuration as the first electrode terminal 51 so that the description of the second to fourth electrode terminals 52 to 54 is omitted.

As shown in FIG. 5, the first electrode terminal 51 has a mounting surface 150*a* and a back surface 150*b* disposed on a side opposite to the mounting surface 150*a*. The mounting surface 150*a* is a surface mounted on a mounting board.

The first electrode terminal 51 has a recessed portion 150 which is indented toward the back surface 150*b* side. The recessed portion 150 includes a bottom portion 151 and a peripheral wall portion 152 disposed on a periphery of the bottom portion 151. The first electrode terminal 51 has a connecting portion 155 on a peripheral edge of the recessed portion 150 on the opening side. The connecting portion 155 is connected to the mounting board.

The first straight wire member 411 of the first coil 41 is connected to the back surface 150*b* side of the bottom portion 151 of the recessed portion 150. An end surface of the first straight wire member 411 is connected to the recessed portion 150 by welding. Laser welding or spot welding can be used as welding, for example.

In this embodiment, the first electrode terminal 51 includes a copper plate 51-1 and a plating film 51-2 which covers the copper plate 51-1, for example. The plating film 51-2 is a Ni/Sn plating, for example. When laser welding is performed from the mounting surface 150*a* side of the bottom portion 151 of the recessed portion 150, the copper plate 51-1 is exposed from the plating film 51-2 on the mounting surface 150*a* side of the bottom portion 151 of the recessed portion 150.

The recessed portion 150 of the first electrode terminal 51 is fitted in the hole portion 21*a* of the case 2 from the bottom surface 2*a* side. When the recessed portion 150 is fitted in the hole portion 21*a*, the bottom portion 151 of the recessed portion 150 is positioned inside the case 2. The peripheral wall portion 152 of the recessed portion 150 is locked to an inner surface of the hole portion 21*a*.

Figure 6:
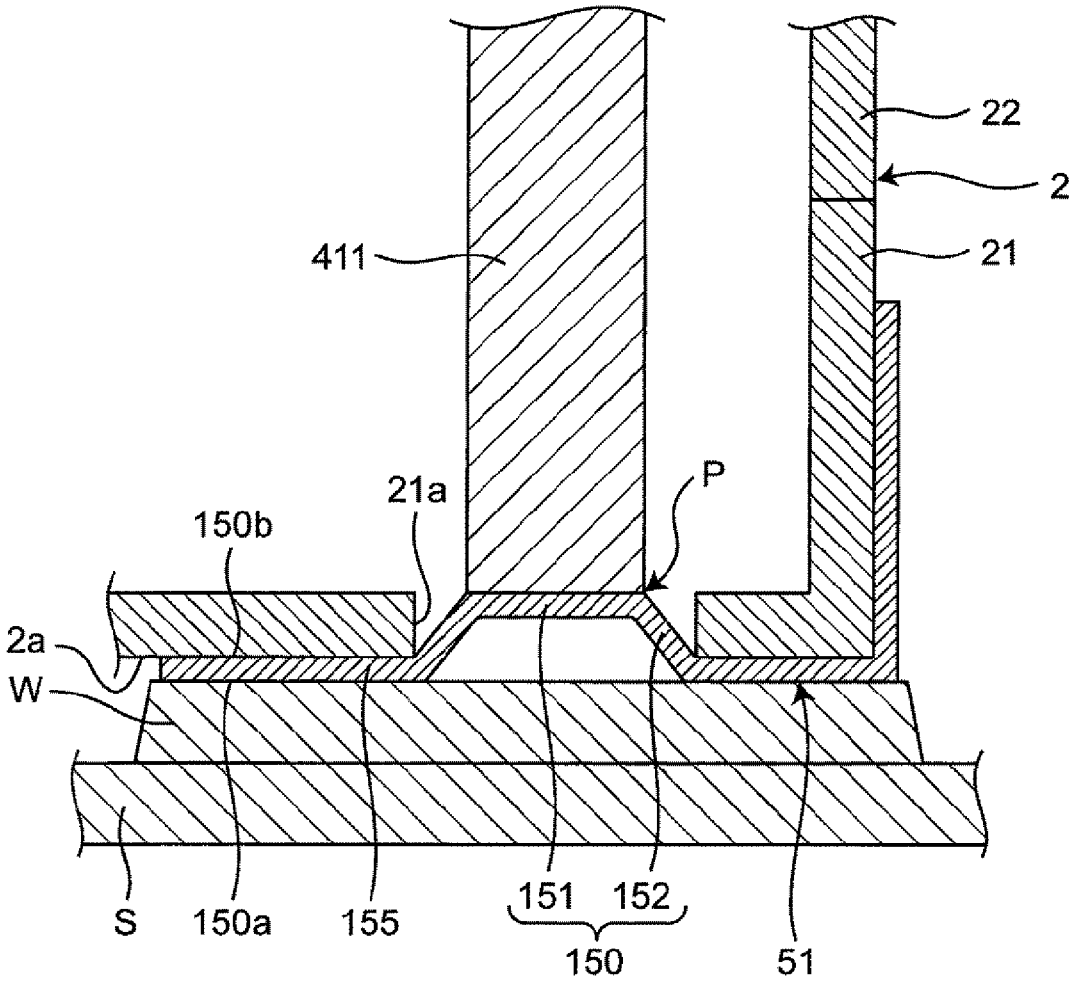
FIG. 6 is a cross-sectional view showing a connection state between a coil and an electrode terminal.

According to the coil component 1, the first electrode terminal 51 has the recessed portion 150, and the first straight wire member 411 of the first coil 41 is connected to the back surface 150*b* side of the bottom portion 151 of the recessed portion 150. With such a configuration, as shown in FIG. 6, in mounting the mounting surface 150*a* of the first electrode terminal 51 on a mounting board S via a solder W, the bottom portion 151 of the recessed portion 150 can be disposed away from the solder W. That is, a connecting portion P between the bottom portion 151 of the recessed portion 150 and the first straight wire member 411 can be disposed away from the solder W. With such a configuration, even when the solder W expands or contracts due to a thermal shock, a stress of the solder W can be absorbed by a portion of the recessed portion 150 between the mounting surface 150*a* and the bottom portion 151 (that is, the peripheral wall portion 152 of the recessed portion 150). As a result, peeling-off between the recessed portion 150 and the first straight wire member 411 which are connected to each other can be suppressed. Accordingly, the favorable conduction between the first coil 41 and the first electrode terminal 51 can be maintained.

Further, even when a thickness of the first straight wire member 411 is increased so that rigidity of the first straight wire member 411 is increased, a stress of the solder W can be absorbed at a portion of the recessed portion 150 between the mounting surface 150*a* and the bottom portion 151 (that is, the peripheral wall portion 152 of the recessed portion 150). Accordingly, the occurrence of cracks in the solder W can be suppressed.

According to the coil component 1, the first straight wire member 411 is connected to the recessed portion 150 by welding and hence, electric resistance can be reduced compared to solder bonding. In this embodiment, when the copper plate 51-1 is exposed from the plating film 51-2 on the mounting surface 150*a* side of the bottom portion 151 of the recessed portion 150, the copper plate 51-1 is oxidized so that it is possible to prevent the solder W from wetting on the bottom portion 151 of the recessed portion 150. Accordingly, it is possible to make the bottom portion 151 of the recessed portion 150 be disposed away from the solder W with more certainty and hence, it is possible to prevent a stress of the solder W from being applied to the connecting portion P between the bottom portion 151 of the recessed portion 150 and the first straight wire member 411 with more certainty.

According to the coil component 1, the first electrode terminal 51 includes the connecting portion 155 which is connected to the mounting board S on the peripheral edge of the recessed portion 150 on the opening side. With such a configuration, when the connecting portion 155 of the first electrode terminal 51 is mounted on the mounting board S, an electric current radially flows along the periphery of the recessed portion 150 between the first straight wire member 411 connected to the recessed portion 150 and the mounting board S. Accordingly, electric resistance can be reduced.

According to the coil component 1, the case 2 has the hole portion 21*a* in which the recessed portion 150 of the first electrode terminal 51 is fitted and hence, a mounting strength of the first electrode terminal 51 mounted on the case 2 is increased.

The connection between the second to fourth electrode terminals 52 to 54 and the first straight wire members 411, 421 can also have substantially the same advantageous effects as the connection between the first electrode terminal 51 and the first straight wire member 411.

(Method of Manufacturing Coil Component)

Next, a method of manufacturing the coil component 1 is described.

Figure 7:
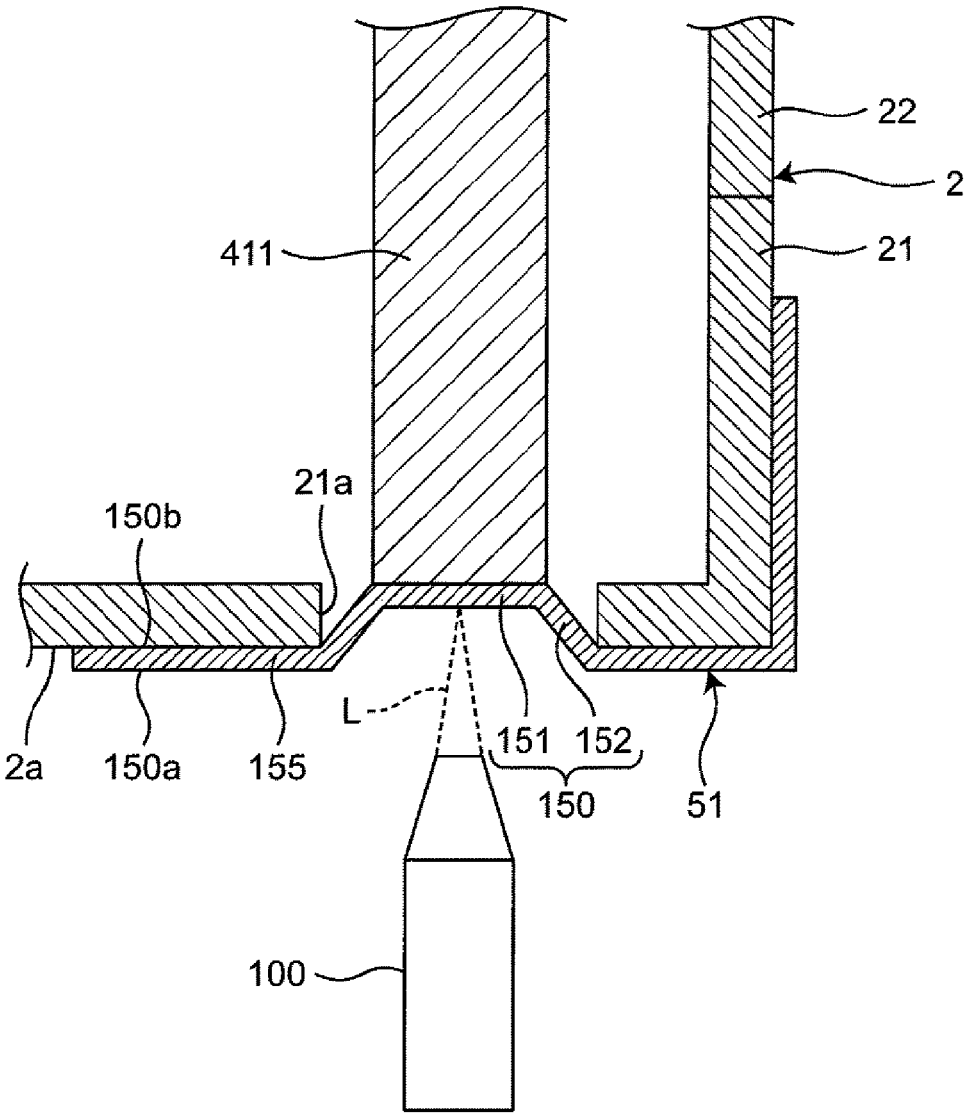
FIG. 7 is a cross-sectional view showing a method of connecting the coil and the electrode terminal with each other.

As shown in FIG. 7, in a state where the first straight wire member 411 is brought into contact with the back surface 150*b* of the bottom portion 151 of the recessed portion 150, the first straight wire member 411 of the first coil 41 is connected to the back surface 150*b* side of the bottom portion 151 of the recessed portion 150 by applying welding from the mounting surface 150*a* side of the bottom portion 151 of the recessed portion 150.

To be more specific, a laser welding machine 100 is disposed on the mounting surface 150*a* side of the bottom portion 151 of the recessed portion 150. A laser beam L is irradiated from the laser welding machine 100 toward the mounting surface 150*a* side of the bottom portion 151 of the recessed portion 150 thus connecting the first straight wire member 411 to the bottom portion 151 of the recessed portion 150 by laser welding. The first straight wire member 411 may be connected to the bottom portion 151 by spot welding or the like other than laser welding.

The second to fourth electrode terminals 52 to 54 are also manufactured in substantially the same manner as the first electrode terminal 51 and hence, the description of the manner of connection of the second to fourth electrode terminals 52 to 54 is omitted.

In this embodiment, the first electrode terminal 51 is fitted in the hole portion 21*a* of the case 2 from the bottom surface 2*a* side and, then, welding is applied from the mounting surface 150*a* side of the bottom portion 151 of the recessed portion 150 thus connecting the first straight wire member 411 to the back surface 150*b* side of the bottom portion 151 of the recessed portion 150. Accordingly, dirt or dust does not enter the case 2 at the time of performing welding.

Such a connecting operation may be performed such that the first straight wire member 411 is connected to the back surface 150*b* side of the bottom portion 151 of the recessed portion 150 and, then, the first electrode terminal 51 is fitted in the hole portion 21*a* of the case 2. With such a connecting operation, the first straight wire member 411 and the first electrode terminal 51 can be assembled to the case 2 after checking the connection between the first straight wire member 411 and the recessed portion 150.

As shown in FIG. 4, a step of assembling the core 3 and the coils 41, 42 and a step of accommodating the core 3 and the coils 41, 42 in the case 2 may be performed either before or after performing the step of connecting the first straight wire member 411 and the first electrode terminal 51 with each other.

According to the method of manufacturing the coil component 1, in a state where the first straight wire member 411 of the first coil 41 is brought into contact with the back surface 150*b* of the bottom portion 151 of the recessed portion 150, the first straight wire member 411 is connected to the back surface 150*b* side of the bottom portion 151 of the recessed portion 150 by applying welding from the mounting surface 150*a* side of the bottom portion 151 of the recessed portion 150. Accordingly, welding can be performed easily. Further, as described previously, in the coil component 1 manufactured as described above, a stress of the solder W is absorbed and hence, peeling-off between the recessed portion 150 and the first straight wire member 411 which are connected to each other can be suppressed.

In this embodiment, in the case where the first electrode terminal 51 includes a copper plate 51-1 and a plating film 51-2 which covers the copper plate 51-1, when the first straight wire member 411 is connected to the back surface 150*b* side of the bottom portion 151 of the recessed portion 150 by applying laser welding from the mounting surface 150*a* side of the bottom portion 151 of the recessed portion 150, the copper plate 51-1 is exposed from the plating film 51-2 on the mounting surface 150*a* side of the bottom portion 151 of the recessed portion 150. Accordingly, a surface of the exposed copper plate 51-1 is oxidized thus forming a copper oxide and hence, it is possible to prevent the solder W from wetting on the bottom portion 151 of the recessed portion 150. As a result, as described previously, it is possible to prevent a stress of the solder W from being applied to the connecting portion P between the bottom portion 151 of the recessed portion 150 and the first straight wire member 411 with more certainty.

The connection between the second to fourth electrode terminals 52 to 54 and the first straight wire members 411, 421 can also acquire substantially the same advantageous effects as the connection between the first electrode terminals 51 and the first straight wire member 411.

(Specific Configuration of Electrode Terminal)

Figure 8A:
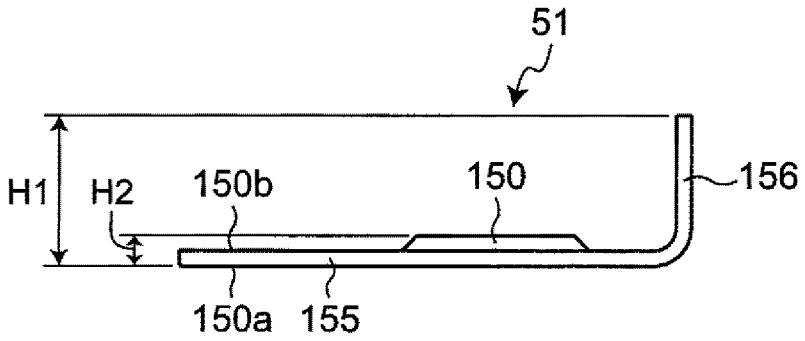
FIG. 8A is a front view of a first electrode terminal.
Figure 8B:
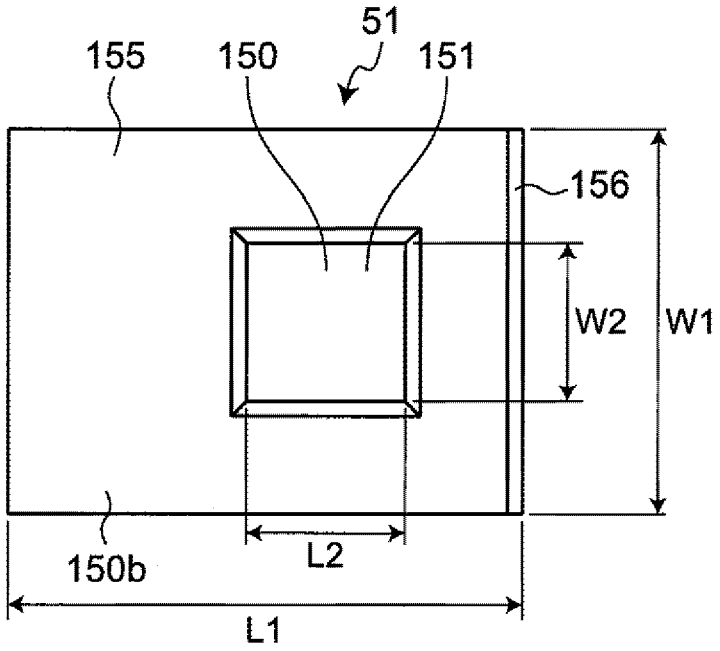
FIG. 8B is a plan view of the first electrode terminal.
Figure 8C:
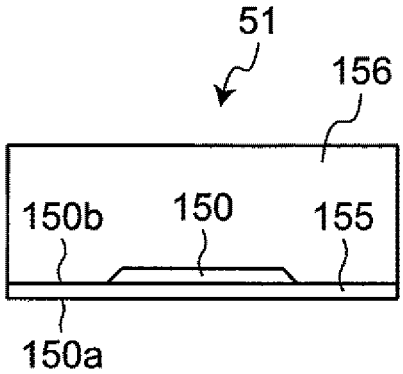
FIG. 8C is a side view of the first electrode terminal.

FIG. 8A is a front view of the first electrode terminal. FIG. 8B is a plan view of the first electrode terminal. FIG. 8C is a side view of the first electrode terminal.

As shown in FIG. 8A to FIG. 8C, the first electrode terminal 51 includes a raised portion 156 which is raised upward from the connecting portion 155 in addition to the recessed portion 150 and the connecting portion 155. In the same manner as the connecting portion 155, the raised portion 156 is also fixed to the case 2 by adhesion. Further, in connecting the connecting portion 155 to the mounting board by soldering, wetting of the raised portion 156 with solder is improved and hence, reliability of the connection can be enhanced.

One example of a material for forming the first electrode terminal 51 and one example of a size of the first electrode terminal 51 are described. As a material for forming the first electrode terminal 51, phosphor bronze is used as a base material, and a Ni plating (thickness: 2 μm) and a Sn plating (matted, thickness: 3 μm) are formed on the base material by surface treatment. A height H1 of the raised portion 156 from the mounting surface 150*a* is set to 2 mm, and a height H2 of the recessed portion 150 from the mounting surface 150*a* is set to 0.4 mm. A width W1 of the connecting portion 155 is set to 5.1 mm, and a length L1 of the connecting portion 155 is set to 6.8 mm. A width W2 of the bottom portion 151 of the recessed portion 150 is set to 2.1 mm, and a length L2 of the bottom portion 151 of the recessed portion 150 is set to 2.1 mm. A thickness of the first electrode terminal 51 is set to 0.2 mm.

The second to fourth electrode terminals 52 to 54 have substantially the same configuration as the first electrode terminal 51 and hence, the description of the second to fourth electrode terminals 52 to 54 is omitted. The configuration of the electrode terminal is not limited to the above-mentioned configuration.

The present disclosure is not limited to the above-mentioned embodiment, and modifications in design can be made without departing from the gist of the present disclosure.

The invention claimed is:

1. A coil component comprising:

a core having an annular shape;

a coil wound around the core; and an electrode terminal for mounting the coil component, the electrode terminal being connected to the coil and having a mounting surface, wherein the coil is formed by connecting a plurality of wire members, the electrode terminal has a recessed portion indented toward a back surface of the electrode terminal which is opposite to the mounting surface, one of the plurality of wire members of the coil is connected to the back surface of the electrode terminal which is opposite to a bottom portion of the recessed portion, and an end surface transverse to a perimeter of one of the plurality of wire members of the coil is connected to the back surface of the electrode terminal.

2. The coil component according to claim 1, wherein one of the plurality of wire members is connected to the recessed portion by welding.

3. The coil component according to claim 1, wherein the electrode terminal includes a copper plate and a plating film which covers the copper plate, and the copper plate is exposed from the plating film on a mounting surface side of the bottom portion of the recessed portion.

4. The coil component according to claim 1, wherein the electrode terminal includes a connecting portion which is connected to a mounting board on a peripheral edge of the recessed portion on an opening side of the recessed portion.

5. The coil component according to claim 1, wherein the coil component includes a case which accommodates the core and the coil, and on which the electrode terminal is mounted, and the case has a hole portion in which the recessed portion of the electrode terminal is fitted.

6. A coil component comprising:

a core having an annular shape;

a coil wound around the core;

an electrode terminal for mounting the coil component, the electrode terminal being connected to the coil and having a mounting surface; and a case covering the core and the coil and having a hole portion on a bottom surface thereof, wherein the coil is formed by connecting a plurality of wire members, the electrode terminal has a recessed portion indented toward a back surface of the electrode terminal which is opposite to the mounting surface, and the recessed portion of the electrode terminal is fitted and disposed in the hole portion of the case from the bottom surface side, one of the plurality of wire members of the coil is connected to the back surface of the electrode terminal which is opposite to a bottom portion of the recessed portion, and an end surface transverse to a perimeter of one of the plurality of wire members of the coil is connected to the back surface of the electrode terminal.

7. The coil component according to claim 1, wherein the end surface of the one of the plurality of wires members faces the back surface of the electrode terminal;

the end surface is a distalmost surface of the one of the plurality of wire members; and the one of the plurality of wire members is not connected to the bottom portion of the recessed portion.

8. The coil component according to claim 6, wherein the end surface of the one of the plurality of wires members faces the back surface of the electrode terminal;

the end surface is a distalmost surface of the one of the plurality of wire members; and the one of the plurality of wire members is not connected to the bottom portion of the recessed portion.

* * * * *